US005102013A

United States Patent [19]

Schneider et al.

[11] Patent Number: 5,102,013

[45] Date of Patent: Apr. 7, 1992

[54] TUBE TYPE CONTAINER WITH PLURAL FLOW CONTROLLER

[75] Inventors: Bernard Schneider; Eric Chevalier, both of Ste Menehould, France

[73] Assignee: Cebal, Clichy, France

[21] Appl. No.: 551,024

[22] Filed: Jul. 10, 1990

[30] Foreign Application Priority Data

Jul. 11, 1989 [FR] France ..... 89-09910

[51] Int. Cl.[5] ..... B65D 35/22

[52] U.S. Cl. ..... 222/94; 222/145

[58] Field of Search ..... 222/94, 129, 136, 145

[56] References Cited

U.S. PATENT DOCUMENTS

| | | | |
|---|---|---|---|
| 2,789,731 | 4/1957 | Marraffino | 222/94 X |
| 2,905,364 | 9/1959 | Marraffino | 222/94 |
| 2,918,199 | 12/1959 | Marraffino | 222/129 X |
| 3,002,658 | 10/1961 | Sajda | 222/94 |
| 3,152,731 | 10/1964 | Prussack | 222/94 X |
| 3,331,535 | 7/1967 | Jarvis | 222/94 |
| 3,468,458 | 9/1969 | Leigh | 222/94 |
| 3,747,804 | 7/1973 | Raaf et al. | 222/94 X |
| 4,098,435 | 7/1978 | Weyn | 222/94 |
| 4,858,785 | 8/1989 | Wilkinson | 222/145 |
| 4,969,767 | 11/1990 | Madden | 222/94 X |

FOREIGN PATENT DOCUMENTS

| | | | |
|---|---|---|---|
| 2053109 | 5/1972 | Fed. Rep. of Germany | 222/94 |
| 2350773 | 4/1975 | Fed. Rep. of Germany | 222/94 |
| 182725 | 5/1986 | France | 222/94 |

*Primary Examiner*—Donald T. Hajec
*Assistant Examiner*—Kenneth DeRosa
*Attorney, Agent, or Firm*—Dennison, Meserole, Pollack & Scheiner

[57] ABSTRACT

A tube for dispensing a paste bead comprising a principal paste and a central thread of a second or secondary paste. The tube comprises a skirt portion, a neck portion having an opening serving as a dispensing orifice and a shouder portion joining the skirt and neck portions. The tube further comprises a distributing member comprising a cover portion disposed between the interior of the neck portion and the interior of the skirt portion, and fixed to the interior of the shoulder portion. This distributing member comprises a plurality of longitudinal, generally tubular passages opening into the interior of the skirt portion and into the interior of the neck portion through the cover portion, the tubular passages being separated by at least one gap which is open to the interior of the tube and open to the neck portion through at least one central aperture in the cover portion. The dispensing orifice is located at least 1.5 mm from the central aperture and has a cross-section smaller than 0.8 times the sum of the cross-sections of the tubular passages and the central aperture.

15 Claims, 3 Drawing Sheets

TUBE TYPE CONTAINER WITH PLURAL FLOW CONTROLLER

BACKGROUND OF THE INVENTION

The present invention relates to the field of flexible tubes for distributing a paste with at least one thread of a typically colored secondary paste.

In their Patent Application FR-A-26222542=EP-A-0315554, the Applicants have described a flexible tube for distributing a paste having colored stripes disposed on the surface of the paste bead. The principal paste passes through a central passage while the colored paste stored under the shoulder of the tube passes via small windows and into the central passage proceeding towards the outlet orifice and becoming applied onto the principal paste bead.

Furthermore, document DE-A-2053109 (=FR-A-2113128=U.S. Pat. No. 3,747,804) disclosed a tube for distributing a principal paste with a central thread of a second paste, its mouth having a cylindrical interior surface comprising the passage for the principal paste about an axial channel for the distribution of the second paste, this distribution channel being supplied with this second paste by tubes which discharge into the annular gap containing the said second paste. With this arrangement, the secondary paste is discharged close to the end of the tube into the center of the flow of principal paste, which is not favorable to the formation of a compact bead.

The Applicants have sought to obtain a tube producing a bead of the same type but of improved compactness and having a well-calibrated central thread of secondary paste. The disposition studied is interesting in many practical cases, particularly when it is desired to mask or protect the substance of the secondary filament until the application of the paste bead or also when it is desired then to make sure that once it has been applied, the paste has been sufficiently worked, such work (for example a massage) being reflected in an homogenisation of the color of the paste which has been worked in this way.

Here, a paste also signifies a thick cream. It was deemed necessary to remain at ambient temperature for the solution sought.

SUMMARY OF THE INVENTION

The invention has as a first object, as is known from DE-A-2053109, a tube for distributing a principal paste with a thread of a second paste or secondary paste, comprising under its distribution orifice which is carried by its neck, a plurality of passages for principal paste, distributed around a central aperture through which the second paste can pass, the passages being separated from one another by gaps which join one another under the central aperture, these gaps being covered at their top end by a membrane or cover which carries the central aperture and which empties into the annular space which serves to accommodate the second paste. According to the invention:

a) the membrane occludes the mouth, the passages and the central aperture, allowing only the following to pass through the mouth;

b) the passages for principal paste are the interior of different tubular portions which emerge on the membrane according to discharging top ends situated on this membrane at a level which is below or the same as that of the top end of the central aperture which is provided for passage of the second paste;

c) the distribution orifice of the tube has a cross-section which is 0.8 times less than the sum of the cross-sections of the portions for passage of the principal and secondary pastes, that is to say the direct passages and the central aperture, and it is situated at least 1.5 mm above the central aperture.

The secondary paste stored between the tubular passages and the shoulder of the tube is usually chosen to have a viscosity close to that of the principal paste and a reduced miscibility with this paste. The pressure applied by the skirt portion of the tube causes a part of the secondary paste to progress through the gaps existing between the tubular portions, the gaps discharging over all the height of the stored secondary paste, until filling up the central part of these gaps which are arranged in a star shape, and until the secondary paste is expelled through the central orifice, the only orifice existing in the upper membrane which occludes the top of these spaces. During this time, the principal paste product is being pushed upwards and, when it is initially below the annular secondary paste reserve, it will be noted that it rises easily and in a controlled fashion through the tubular passages without disturbing the flows of secondary paste circulating in the gaps between these passages. The flows of principal paste join around the flow of secondary paste above the membrane occluding the mouth and defining with the mouth and its top end which has a narrower orifice a chamber for relaxation and agglomeration in which this joining or welding takes place. It is important that the flows of principal paste do not discharge into this expansion chamber before the central thread or filament of the second paste, the crown pattern of joining of the principal paste then taking place before this crown is applied around the central thread. The narrower orifice which is at the end of this chamber forming an extrusion chamber produces an essential effect of compressing the paste bead, which thus is surprisingly compact and well calibrated and of regular and reproducible structure with a central filament sheathed continuously in the principal paste.

The preceding relaxation and agglomeration chamber must be sufficiently high, at least 1.5 mm above the central aperture, so that it fulfills correctly its described role. It has been noted that, if it were of too low a height, pressure on the tube produced a blockage between the membrane and the end of the tube carrying the distribution orifice, preventing or disturbing the delivery of the pasty bead with the central filament.

A preferred disposition of the tubular portions of passage of the principal paste will be described in the Examples. In order to produce a favorable lowering of the upper discharging ends of the portions of passage of the principal paste in relation to the upper end of the central aperture, this upper end may be caused to project by 1 to 2 mm in respect of the membrane. For this lowering or difference in level, it is also possible to adopt a value which will typically be greater the more substantial is the difference in viscosity of the principal and secondary pastes, and which will be comprised between 1.5 and 4 mm whether the upper end of the central aperture is projecting or not.

The relaxation and agglomeration chamber of the mouth preferably has a cross-section which is at least equal to 1.2 times the sum of the straight sections of the portions for passage of pastes between the membrane and at least 1 mm above the upper end of the central aperture for passage of the secondary paste. Above this relatively free portion for the flow of pastes, there is an annular narrowing which defines the distribution orifice.

Additionally, to obtain a uniform sheathing of the delivered paste bead, it is essential that the bottom ends of the tubular portions for passage of the principal paste should be at least 5 mm lower than the interior of the shoulder, when the tube has its distribution orifice at the top. When the filling level of secondary product is situated at least 1 mm on this side of the bottom of the shoulder, there is then a satisfactory separation of principal paste and secondary paste from the onset of pressure being applied to the tube, avoiding the secondary paste passing through the tubular portions to the exterior of the flows of principal paste and avoiding their marking the outside of the distributed paste feed.

Other particular features of the tube according to the invention and its alternative embodiments will be explained with the help of the examples and the drawings.

The invention also relates to a tube for distributing a principal paste with a plurality of central threads, the spaces for progression of each of these central threads being isolated from one another at the level of their expulsion, and being made by separate orifices which are close to the axis.

The invention finally relates to the use of the tubes according to the invention for the distribution of a paste which is to be intimately blended, the secondary colored paste or pastes serving to trace or to demonstrate the extent or the quality of the blending by the progressive homogenisation of the color.

DESCRIPTION OF THE PREFERRED EMBODIMENTS

EXAMPLE 1

Figure 1:
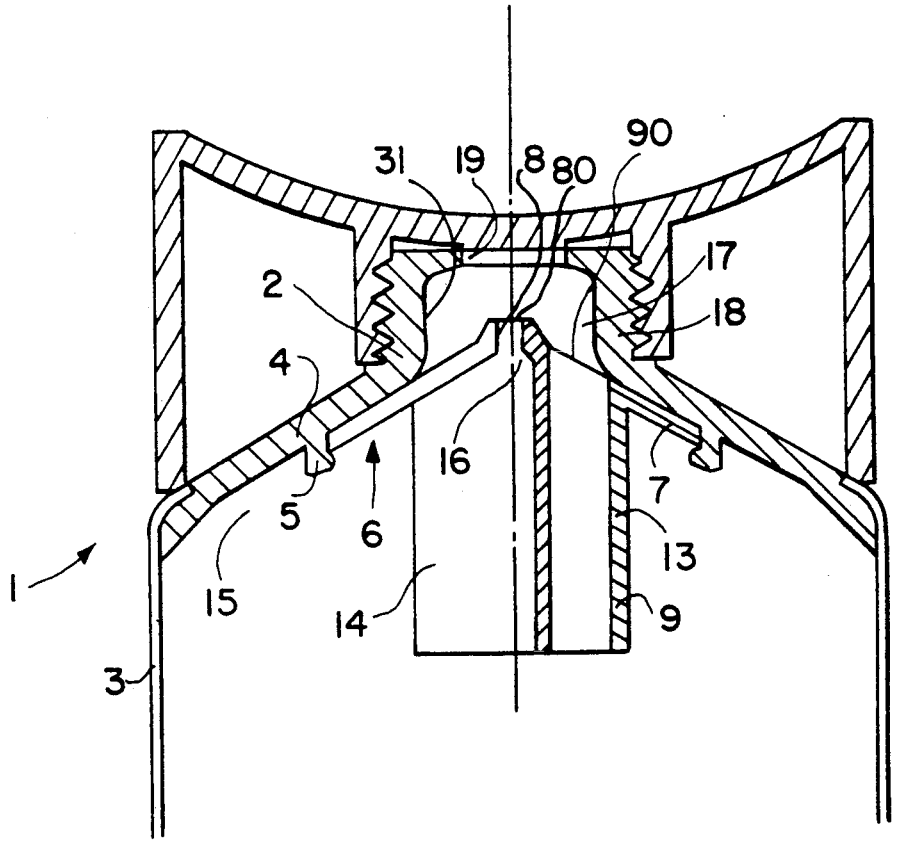
FIG. 1 shows a cross-section through a first tube fitted with a special interior member which is locked in place under the shoulder of the tub.
Figure 2:
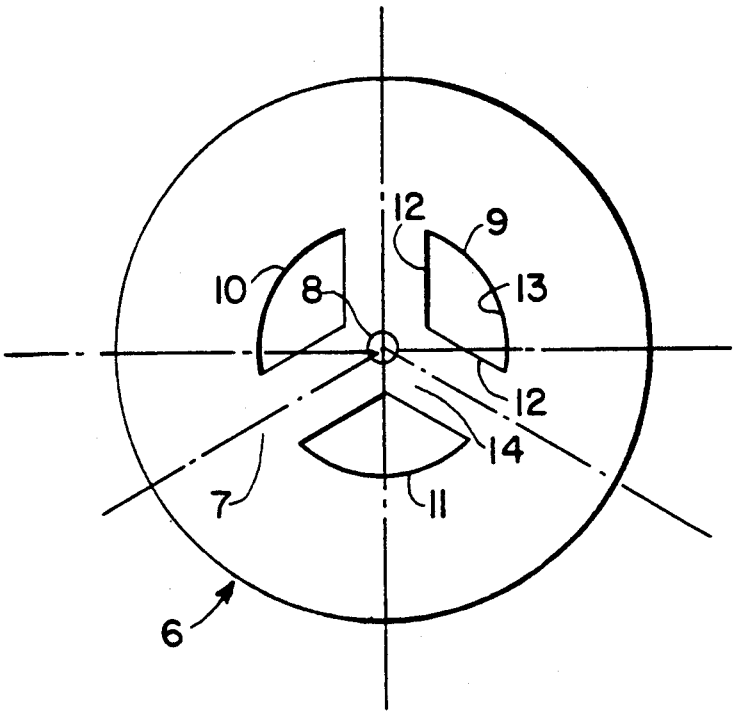
FIG. 2 is a diagram showing the structure of the aforementioned special member, viewed from above.

The tube 1 in FIG. 1 has a head 2 of high density polyethylene (HD.PE) moulded onto a metalloplastic skirt 3 which has an outside diameter of 40 mm. The underneath of the shoulder 4 comprises a snap-locking rib 5 for retaining the special member 6. This latter comprises a substantially conical membrane or cover portion having a star-shaped center 7 (FIGS. 1 and 2) and comprising at its apex an aperture 8 of which the top end 80 extends 1.5 mm beyond the surface of the membrane 7, this aperture 8 of diameter 1.5 mm thus having a height of 1.7 mm. This membrane 7 is connected to the upper end 90 of three longitudinal tube portions 9 to 11 shown best in FIG. 2. Each portion 9 to 11 has a cross-section comprising two rectilinear sides 12 forming an angle of 120° and a circular outer base 13 with a radius of 5.5 mm, the outer base 13 of the three portions forming an incomplete circular cylinder centered on the axis of diameter 11 mm, with an inner wall extending the interior 31 of the mouth 18. These three portions 9, 10 and 11 serve to pass the principal paste product directly so that it is expelled by the tube being pressed. In general, dispositions having up to 7 tubular portions for direct passage may be employed but 3 or 5 portions will be preferred.

Portions 9, 10 and 11 define inter se under the membrane 7 radial gaps 14 3 mm wide (FIG. 2) emerging into the annular storage space 15 comprised between the special member 6 and the shoulder 4 over all the height of the secondary paste reserve. Routing of the secondary paste product from the storage space 15 as far as the outlet orifice 8, passing through the radial portions of gaps 14 and their central axial portion 16 is easy. The chamber 17 of the mouth 18 and its narrower orifice 19 favor the grouping together of the three flows of principal paste product about the central filament of secondary paste product. p The tests were carried out on a plurality of tubes of this arrangement, the chamber 17 of the mouth having a diameter of 10 mm up to 2 mm above the end 80 of the central aperture 8, and the distribution orifice 19 of the tube 1 having a diameter of 5.5 mm, the principal and secondary paste products being respectively white and blue and having closely selected viscosities (30,000 cp). The uniformity of the structure of the bead obtained during the greater part of distribution has been verified.

EXAMPLE 2 (FIG. 3)

However, it has been noted in earlier tests that the central filament of paste product exhibited discontinuity towards the end of distribution Examination of the interior of some of the tubes showed that the snap-locking rib 5 was able to disturb the flow of colored product and a tube 20 has been suggested in which the snap-locking relief portion 21 does not pass beyond the shoulder 22, the membrane 7 on the special member 6 becoming housed in a frustoconical depression 23 corresponding to a thinning of this shoulder 22. This arrangement provides satisfaction until the tube 20 is completely emptied.

EXAMPLE 3

Figure 4:
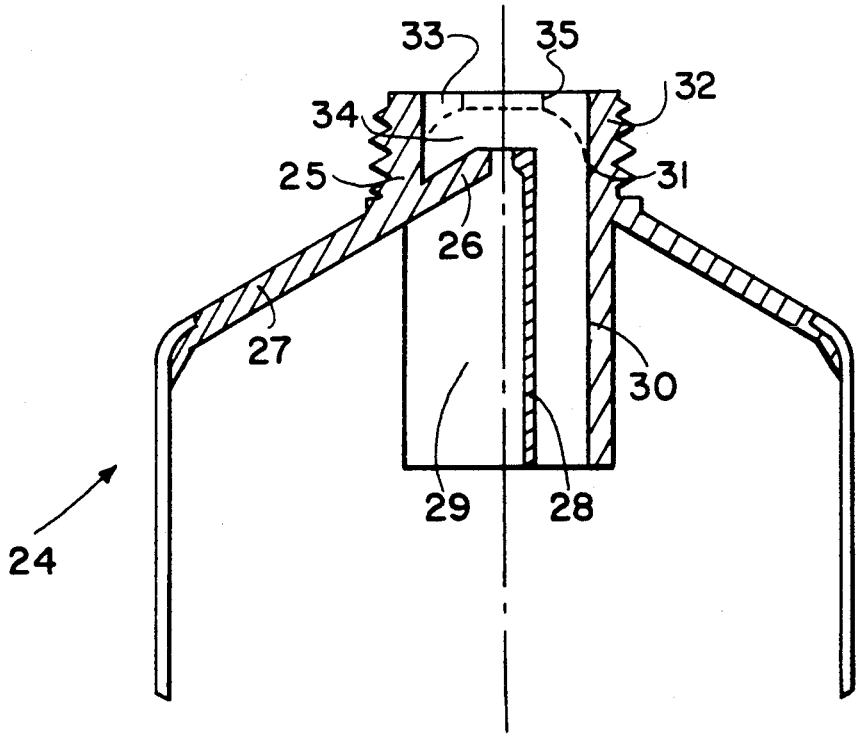
FIG. 4 shows a monobloc tube according to the invention, in cross-section.

The tube 24 in FIG. 4 comprises a head 25 in one step onto the skirt 3, this head 25 comprising a central portion consisting of an upper membrane 26 which extends the shoulder 27 and three longitudinal tubular portions such as 28 having the same geometry as that of the member 6 (FIGS. 1 and 2) and defining inter se gaps 29 which are likewise arranged in the same way. These portions 28 each have two radial walls and one circular cylindrical wall 30 which extends the interior 31 of the mouth 32.

To facilitate removal from the mold, this interior 31 of the mouth 32 is straight, which gives a less satisfactory compactness to the paste bead. A first improvement resides in providing the interior of this mouth with a member 33 which forms a chamber 34 and a narrower orifice 35 as in Example 1, this member 33 being shown diagrammatically by the broken lines in FIG. 4.

EXAMPLE 4

Figure 5:
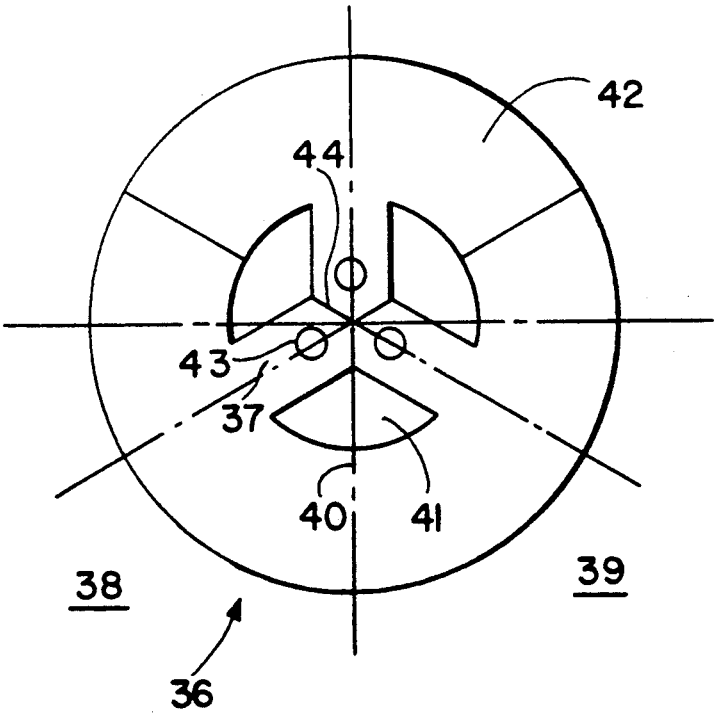
FIG. 5 shows a second special member for obtaining a paste bead comprising three central paste filaments, viewed from below.
Figure 3:
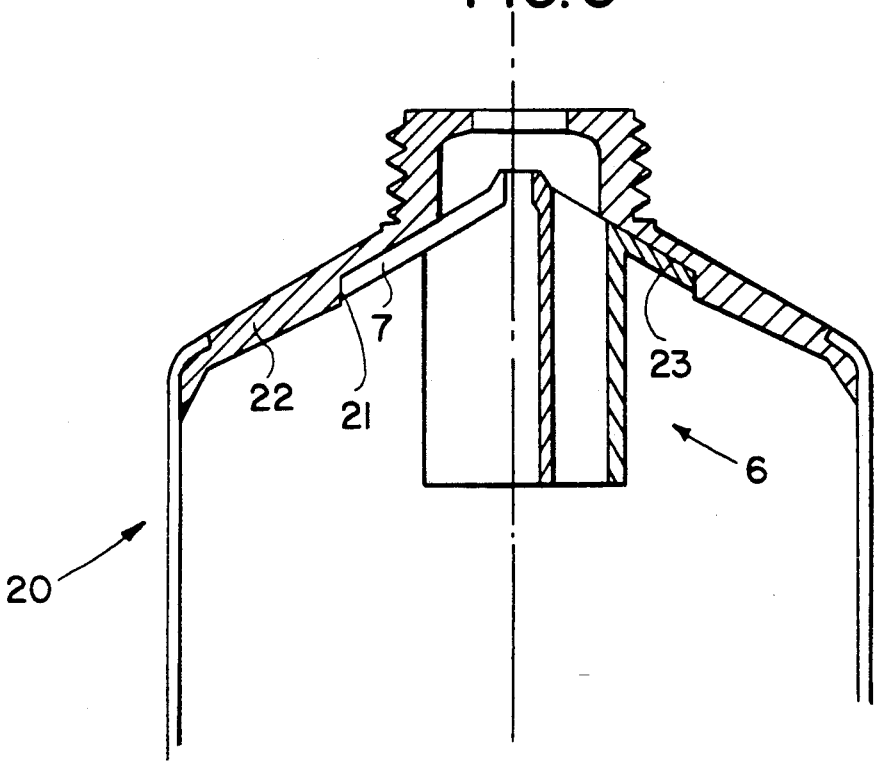
FIG. 3 shows a second tube provided with the same special member, likewise in cross-section.

FIG. 5 shows a special member 36 to be fixed under the shoulder of a tube as in Examples 1 and 2 (FIGS. 1 and 3) and which makes it possible to obtain three central paste filaments in one paste bead. An essential principle of the invention, viz. the expulsion of the principal paste through a plurality of direct offset passages and the forced routing of a secondary paste product between the annular space which contains it and a central orifice under the covering of an upper membrane which isolates the aforementioned direct passages is adapted in the following way: each radial gap 37 corresponds to an annular storage sector 38 to accommodate a particular colored product, the sectors 38 and 39 of each group of two different colored products being separated by partitions 40 extending from a direct passage 41 as far as the circumference of the membrane 42, in contact with the shoulder of the tube after fitment of the member 36.

At the level of the central zone, the three radial gaps 37 are isolated from one another by a star-shaped sealing-tight partition 44 fixed to the inner edges of direct passages such as 41 and to the upper membrane 42. This membrane 42 carries close to its center three outlet orifices such as 43, each orifice 43 allowing expulsion of a secondary product which has arrived in the corresponding radial gap 37.

Thanks to this special member 36, a paste bead of a principal product and containing three secondary paste threads of different colors is obtained, these colors, such as green, red and blue, remaining distinct in the head in spite of their proximity.

The special members or monobloc heads of the invention are of plastic material, preferably of a fairly rigid plastics material such as HD.PE or PP (polypropylene).

The reproducibility of the structure of the composite paste bead obtained is remarkable.

Thus, the invention typically relates to the protection of a central paste product or the demonstration of work carried out on the paste bead.

The tube according to the invention is used for the packaging of paste products in the cosmetics, pharmaceuticals, paramedical, hygiene and foodstuffs fields.

We claim:

1. A tube for dispensing a paste bead comprising a principal paste and a central thread of a second or secondary paste, said tube comprising a skirt portion, a neck portion having an opening therein serving as a dispensing orifice, and a shoulder portion joining the skirt portion and neck portion, said tube further comprising a distributing member located in the interior thereof, said distributing member comprising a cover portion disposed between the interior of the neck portion and the interior of the skirt portion and fixed to the interior of the shoulder portion, and a passage portion extending into the interior of the skirt portion, said distributing member comprising a plurality of longitudinal, generally tubular passages opening into the interior of the skirt portion and into the interior of the neck portion through said cover portion, said tubular passages being separated by at least one radial gap which is open to the interior of the tube, and which is open to the neck portion through at least one central aperture in said cover portion, said cover portion blocking said neck portion and allowing paste to pass to the neck portion only through said tubular passages and said at least one central aperture, said tubular passages opening into said neck portion at a level which is no closer to said dispensing orifice than said at least one central aperture, said dispensing orifice being located at least 1.5 mm from said at least one central aperture and having a cross section smaller than 0.8 times the sum of the cross sections of the tubular passages and at least one central aperture.

2. A tube according to claim 1, in which said tubular passages have a cross-section in the form of sectors of a circle, with circular peripheral walls being aligned according to a circular axial cylinder and radial walls defining therebetween said at least one gap which has a longitudinal star-shaped and is centered on the longitudinal axis of the cylinder and having radial arms of the same width.

3. A tube according to any one of claim 1 or 2, in which said central aperture forms an axial chimney of a height greater than a mean thickness of said cover portion, and has a top end projecting by 1 to 2 mm in relation to said cover portion.

4. A tube according to any one of claims 1 or 2, comprising between said dispensing orifice and said cover portion, a chamber of cross-section at least equal to 1.2 times the said sum of the cross-sections of said tubular passages and said at least one central aperture, and up to at least 1 mm above the top end of the said central aperture.

5. A tube according to either of claims 1 or 2, in which said central aperture has a top end and said tubular passages have top ends and said top ends of the tubular passages are situated 1.5 to 4 mm lower than the top end of said central aperture.

6. A tube according to either of claims 1 or 2, in which said tubular passages have bottom ends situated at least 1.5 to 4 mm lower than the interior of the shoulder of said tube.

7. A tube according to either of claims 1 or 2, in which said distributing member is molded separately and fixed to the interior of said tube.

8. A tube according to any one of claims 1 or 2, in which the distributing member is produced by monobloc molding together with the shoulder and neck portions, said cover portion being an extension of the shoulder portion, the tubular passages having peripheral walls extending the interior of the neck portion.

9. A tube according to claim 3 in which said distributing member is produced by monobloc molding together with the shoulder and neck portions, said cover portion being an extension of the shoulder portion, the tubular passages having peripheral walls extending the interior of the neck portion.

10. A tube according to claim 3 in which the distributing member is molded separately and fixed to the interior of the tube.

11. A tube according to claim 4 in which the distributing member is molded separately and fixed to the interior of the tube.

12. A tube according to claim 4 in which said distributing member is produced by monobloc molding together with the shoulder and neck portions, said cover portion being an extension of the shoulder portion, the tubular passages having peripheral walls extending the interior of the neck portion.

13. A tube according to claim 1, in which said at least one gap comprises a plurality of gaps separating said tubular passages.

14. A tube for dispensing a paste bead comprising a principal paste and a plurality of central threads of secondary pastes, said tube comprising a skirt portion, a neck portion having an opening therein serving as a dispensing orifice, and a shoulder portion joining the skirt portion and neck portion, said tube further comprising a distributing member located in the interior thereof, said distributing member comprising a cover portion disposed between the interior of the neck portion and the interior of the skirt portion and fixed to the interior of the shoulder portion, and a passage portion extending into the interior of the skirt portion, said distributing member comprising a plurality of longitudinal, generally tubular passages for the principal paste opening into the interior of the skirt portion and into the interior of the neck portion through said cover portion, said tubular passages being separated by a plurality of radial gaps open to the interior of the tube, said gaps being separated from each other in the central portion of the distributing member by a star-shaped central partition fixed to said passages, each gap being open to the neck portion through an aperture in said cover portion and disposed between the gap and the interior of the neck portion in the vicinity of the partitioned central portion of the member, said cover portion blocking said neck portion and allowing paste to pass to the neck portion only through said tubular passages and said central apertures, each radial gap being open to the interior of the tube in a sector of the interior of the shoulder portion for storing a secondary paste, said sectors being separated from each other by outer partitions, each outer partition extending from one of said tubular passage to the periphery of the cover portion, said dispensing orifice being located at least 1.5 mm from said central apertures and having a cross section smaller than 0.8 times the sum of the cross sections of the tubular passages and apertures.

15. A tube according to either of claims 1 or 14 for the distribution of said pate bead which has to be intimately blended, the secondary paste or pastes being colored and serving to demonstrate such blending.

* * * * *